United States Patent [19]

Brown et al.

[11] 4,189,204

[45] Feb. 19, 1980

[54] INTEGRATED WIRE TERMINATION SYSTEM WITH REFLOW BONDED RETAINER

[75] Inventors: Harry W. Brown, Big Bend; Erich E. Heider, West Allis, both of Wis.

[73] Assignee: Eaton Corporation, Cleveland, Ohio

[21] Appl. No.: 886,992

[22] Filed: Mar. 16, 1978

[51] Int. Cl.[2] ..... H01R 9/06; H01R 13/42

[52] U.S. Cl. ..... 339/275 R; 29/629; 29/630 R; 339/217 S

[58] Field of Search ..... 29/629, 630 R, 630 A; 228/254; 339/74 R, 253, 278 C, 275 R, 275 C, 217 S

[56] References Cited

U.S. PATENT DOCUMENTS

| | | | |
|---|---|---|---|
| 3,161,451 | 12/1964 | Neidecker | 339/74 R |
| 3,170,752 | 2/1965 | Van Horssen | 339/74 R |
| 3,200,355 | 8/1965 | Dahlen | 333/79 |
| 3,257,636 | 6/1966 | Van Horssen | 29/630 R |
| 3,525,066 | 8/1970 | Magee et al. | 339/278 C |

*Primary Examiner*—Neil Abrams

*Attorney, Agent, or Firm*—Hugh R. Rather; William A. Autio

[57] ABSTRACT

A connector socket terminal structure of the integrated wire termination system (IWTS) type is disclosed for accepting wires with complemental mating pins, and is especially suitable for use in environmentally sealed aircraft switches. A retainer is disposed in a hollow terminal and serves to lock the wire termination pin in place in the terminal and ensure good electrical contact. The retainer is integrally bonded in the terminal by a tin reflow process. The terminal is plated with silver, and the retainer with tin. The retainer is inserted into the terminal and the assembly is immersed in a hot oil bath to melt the tin, the oil preventing the formation of oxides on the tin and silver surfaces and also reducing surface tension of the tin to facilitate good tin flow. Upon cooling, a good electrical and mechanical bond is formed between the tin on the retainer and the silver on the terminal. A wire termination pin may then be inserted into the terminal, to be locked therein by the retainer.

25 Claims, 4 Drawing Figures

Fig. 1
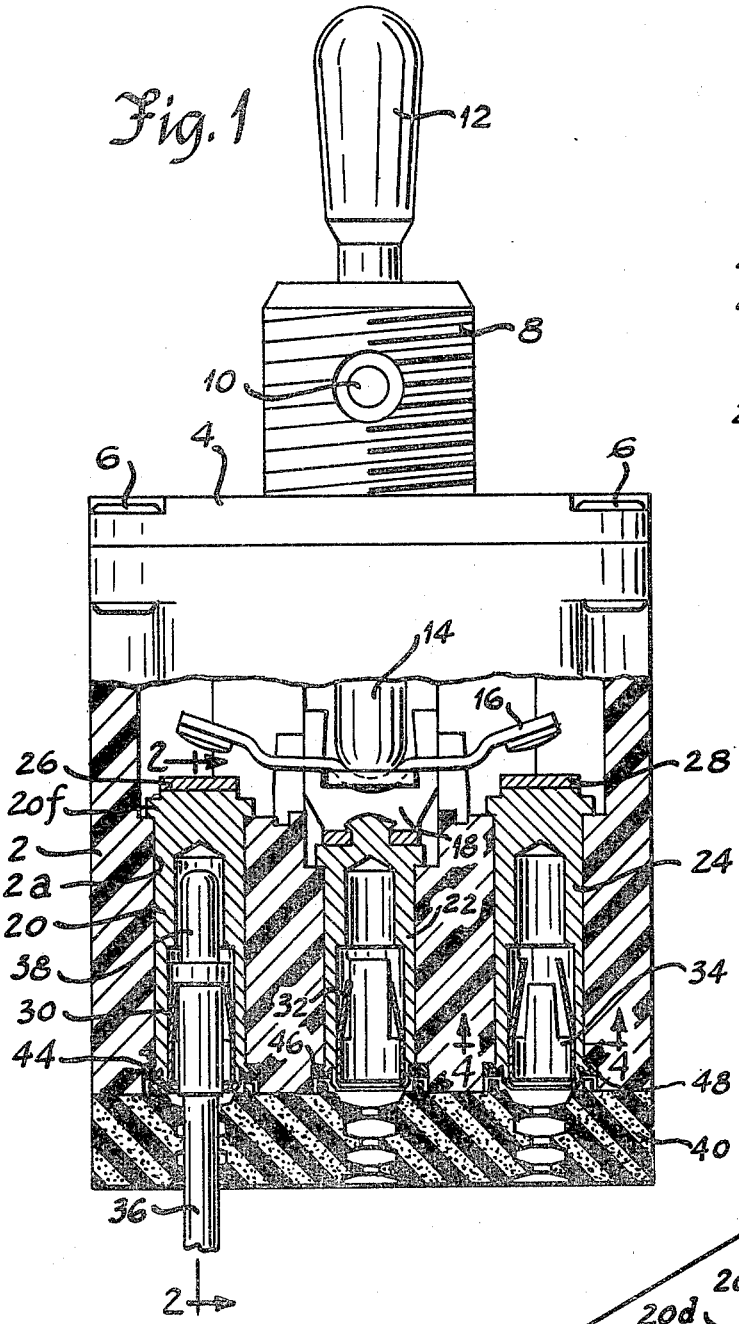
Fig. 2
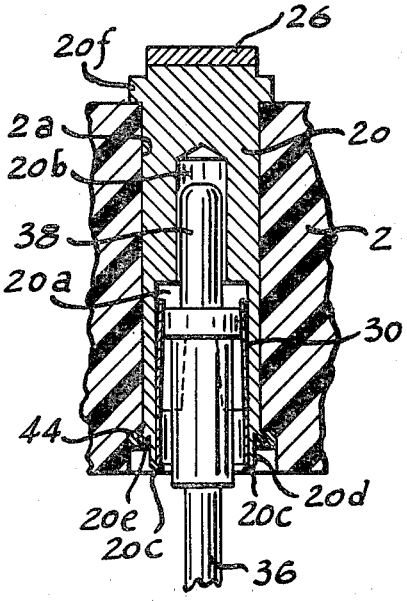
Fig. 3
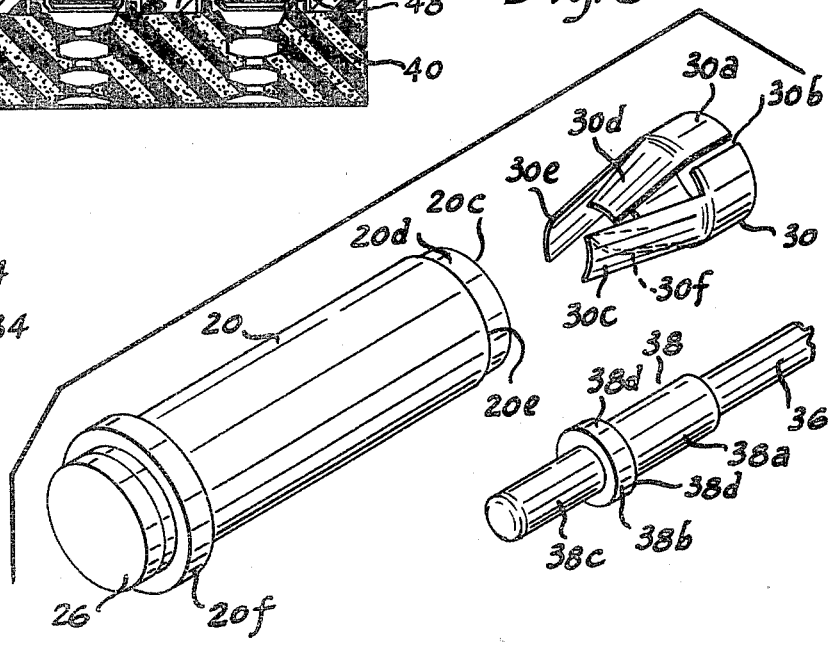
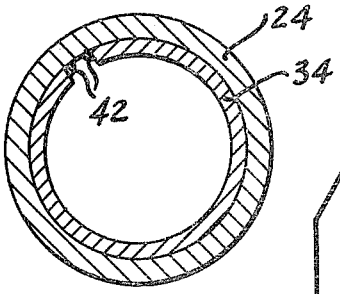
Fig. 4

INTEGRATED WIRE TERMINATION SYSTEM WITH REFLOW BONDED RETAINER

BACKGROUND OF THE INVENTION

Integrated wire termination systems, including rear release electrical connectors, are known in the art. For example H. W. Hults, U.S. Pat. Nos. 3,683,322 issued Aug. 8, 1972 and 3,721,945 issued Mar. 20, 1973, and W. B. Halbeck U.S. Pat. No. 3,717,838, issued Feb. 20, 1973, all assigned to the assignee of the present invention. A shouldered pin is inserted into a terminal having a spring tabbed retainer therein whose tabs are laterally flexed as the shoulder of the pin slides thereby, whereafter the tabs spring back to engage the backside of the shoulder and prevent removal of the pin. Several means of mounting the retainer inside the terminal have been used, such as mechanical entrapment and spot welding. While these means have been useful, several problems have been encountered therewith, such as high cost and poor reliability.

Additionally, prior means do not allow inspection to determine if an adequate retainer assembly strength has been achieved.

A particular problem with spot welding is the formation of burrs caused by excess or splattered flash, and/or the formation of an out of round condition caused by the pressure of the electrode during welding, either of which may impede pin insertion.

SUMMARY OF THE INVENTION

The present invention relates to improvements over prior wire termination systems, including advantages thereover such as lower assembly costs and avoidance of mechanical failure.

An additional advantage is the enablement of efficient and inexpensive quality control. The present invention affords ease of inspection wherein a simple examination, preferably by microscope, shows the degree of mechanical bond which has been achieved. For example, in the disclosed preferred embodiment, the inspector simply looks for a fillet of tin 42, FIG. 4, at the edge of the retainer.

A particular advantage over spot welding is the avoidance of burrs and of an out of round condition.

An object of the present invention is to provide an improved integrated wire termination system.

Another object is to provide an improved method of mounting the retainer inside the terminal.

These and other objects are carried out by providing an integral electrical and mechanical bond between the retainer and the terminal. The bond is formed by the reflow of a metal or metal alloy coating on at least one of the retainer and the terminal, the metal or metal alloy having a melting point less than that of both the retainer and the terminal.

BRIEF DESCRIPTION OF THE DRAWINGS

FIG. 1 is a side elevation view of an environmentally sealed toggle switch, with the lower portion of the housing cut away to show a sectional view of the connector socket terminal structure.

FIG. 2 is an isolated fragmentary enlarged sectional view of one of the terminals taken along line 2—2 of FIG. 1.

FIG. 3 is an isometric view of a terminal, retainer, and pin.

FIG. 4 is an enlarged cross-sectional view taken along line 4—4 of FIG. 1.

DESCRIPTION OF THE PREFERRED EMBODIMENT

There is shown in FIG. 1 a toggle switch mechanism known in the art, and thus it will be only briefly described. A comparable structure is shown in H. W. Brown U.S. Pat. No. 3,350,521, issued Oct. 31, 1967, and assigned to the assignee of the present invention.

An open-topped insulating housing 2 is closed and sealed by a cover 4 mounted thereto by rivets 6. The cover has a threaded bushing 8 with a pivot pin 10 journaled therein for pivotally mounting toggle lever 12. The toggle lever has a spring-loaded plunger 14 at its inner end slidable along the shaft of the toggle lever and biased into engagement with a teeter-totter contactor 16. The contactor rocks on a central fulcrum 18 and completes a circuit between a central contact and either the right or left contact in response to clockwise or counterclockwise rocking, respectively, of the contactor. FIG. 1 shows a neutral condition, with no circuit completed. The toggle lever is environmentally sealed in the bushing by a seal such as shown in H. W. Hults U.S. Pat. No. 3,483,345, issued Dec. 9, 1969, and assigned to the assignee of the present invention. Such seal can also provide sealing between cover 4 and base housing 2.

Mounted in the bottom of the housing are three connector socket terminal structures. These terminal structures are preassembled, to be described hereinafter, and then mounted in base 2, to be presently briefly described. For a fuller explanation of the mounting of the terminal structures in the base, reference may be had to H. W. Brown U.S. Patent application Ser. No. 887,222 filed Mar. 30, 1978 which describes and claims such mounting.

The left terminal structure includes a terminal 20, FIGS. 1 and 2. Terminal 20 is inserted from above down into a complemental bore **2*a* in the base until enlarged annular shoulder portion 20*f* is stopped by the base. A shoulder 20*e* on the other end of the terminal is then upset by a staking operation to outwardly crimp such shoulder and hence provide a strong mechanically interlocked retention in the base. Next, an environmental seal is made by applying liquid epoxy resin 44 of a quantity sufficient to surround shoulder 20*e* and wick into the space between terminal 20 and the wall of bore 2*a* to a depth of about ⅔ the depth of bore 2*a*. The epoxy not only provides an environmental seal but also provides a tighter fit of the terminal in the bore by taking up tolerance deviations between the diameter of terminal 20 and of bore 2*a*. Mounting of the other terminal structures in the base is comparable, including terminals 22 and 24 and epoxy seals 46 and 48**.

In final assembled condition, terminals 20 and 24 have contacts 26, 28, respectively, brazed thereon. Fulcrum 18 is riveted to central terminal 22. The terminals have conductive retainers 30, 32 and 34 mounted therein and in good electrical contact therewith. Retainer 34 is shown in a position rotated 90° about the longitudinal axis of its terminal from the position shown for retainers 30 and 32. The retainers are identical and their orientation is immaterial, the rotated position of retainer 34 being used to show more of the details of the retainers.

Inserted from below into each terminal is a conductor wire terminated in a conductive head pin, for example wire 36 having an insulating sheath cover, terminated in pin 38 inserted into terminal 20. An insulating gasket 40 with multi-ribbed apertures is disposed below the housing and the pins are inserted therethrough, the gasket providing a further environmental seal.

The terminal structures will now be described in detail with reference to FIGS. 2 and 3. Retainer 30 has an annular bottom portion 30*a* with slit 30*b* to allow radial compression of the retainer when inserted into hollow terminal 20 and provide a biased tight fit therein, to be described more fully hereinafter. The retainer has four circumferentially spaced upstanding tabs 30*c*, 30*d*, 30*e* and 30*f* extending from annual portion 30*a* and bent inwardly toward the central longitudinal axis of the terminal. Tabs 30*c* and 30*e* are disposed opposite each other and extend higher than tab pair 30*d* and 30*f*.

Head pin 38 has a bottom hollow portion 38*a* mounting the bare end of wire 36, an annularly larger shoulder portion 38*b*, and a leading head portion 38*c*. Upon insertion of pin 38 into terminal 20 with retainer 30 therein, shoulder portion 38*b* engages and laterally or radially outwardly flexes tabs 30*c*, 30*d*, 30*e* and 30*f* until shoulder portion 38*b* slides by tabs 30*d* and 30*f* whereafter tabs 30*d* and 30*f* snap inwardly against bottom portion 38*a* and engage the backside 38*d* of the shoulder to thus lock pin 38 in place in terminal 20. A special tool such as that shown in U.S. Pat. No. 3,110,093, issued Nov. 12, 1963, may be used to remove the pin. In locked position of the pin, tabs 30*c* and 30*e* engage arcuate sections of the outer circumference of shoulder 38*b* affording further good electrical contact.

Terminal 20 has a lower hollow portion or cavity 20*a*, FIG. 2, for receiving retainer 30, and a smaller hollow portion or cavity 20*b* for receiving leading head portion 38*c*. While a relatively snug fit of head 38*c* into cavity 20*b* is preferred, such fit is not necessarily relied upon for electrical contact because a parallel current conduction path is: wire 36 to pin 38 to retainer 30 to a reflowed metal or metal alloy bond (preferably tin as described hereinafter) to terminal 20 to contact 26.

Assembly of the terminal structure will now be described including the preferred mounting of retainer 30 in terminal 20.

Retainer 30 is made of beryllium copper and is plated with tin. Terminal 20 is made of brass and is plated with nickel. The nickel coating is desirable to prevent interaction between the zinc in the brass and the tin, and thus avoid gradual weakening and eventual failure of the bond (to be described) between the tin and the terminal. Contact 26 is brazed on. The contact and terminal is then plated with silver to improve conductivity and provide corrosion resistance.

The retainer is inserted into the terminal to a depth of about 0.010 in. from the outer lip edge 20*c* of reduced bottom portion 20*d* of the terminal. The width of gap or slit 30*b* is reduced upon such insertion to provide an inherently biased fit to aide in retention of the retainer in its proper position within the terminal during the remainder of the assembly process. The bottom edge 20*c* of reduced portion 20*d* is curled or peened over inwardly, FIG. 2, around the bottom edge of the retainer to trap the retainer in the terminal and provide further retention during subsequent assembly.

The terminal and retainer are then heated to melt and reflow the tin to create when solidified a bond between the retainer and terminal. The assembly is immersed in an oil bath at about 480° F., the oil acting as a flux to prevent oxidation of the tin and silver surfaces. Tinning oil is used to reduce the formation of oxides on the tin and silver surfaces, and also to reduce surface tension of the tin so as to facilitate good tin flow. After sufficient time to melt and reflow the tin, the assembly is removed from the hot oil and allowed to cool to room temperature, and then washed and rinsed thoroughly to remove traces of oil. Both a good electrical and a good mechanical bond is formed between the tin on the retainer and the silver on the terminal.

As illustrated in FIG. 4, the present invention enables visual inspection to determine sufficiency of the bond. The presence of fillets of tin 42 (microscopic examination preferred) at the retainer-terminal interface along the edges of the retainer slit indicates that the tin has flowed sufficiently to form a good bond. The inspector merely examines the terminal structure from the hollow end, thus eliminating costly and time consuming manual pull testing. The present invention thus enables efficient, inexpensive and reliable quality control. Furthermore, the terminal structure may be inspected prior to mounting in base 2 whereby to avoid rejecting an entire assembled base unit because of a single bad terminal structure.

Various alternatives are of course possible. For example, other methods of heating could be used such as gas flame, induction heating, etc., though care should be exercised to avoid overheating the parts; for example, in the specifically disclosed embodiment, avoid oxidizing the tin and silver. The terminal may be made of other conductive materials besides brass; likewise, any coating on the terminal is not a constraint of the invention. The retainer is preferably made of beryllium copper, though numerous other materials can be used, preferably of high tensile strength and preferably zinc free, for example phosphor-bronze is a good substitute. The retainer may be plated with other metals or metal alloys besides tin provided such metals or metal alloys have a melting point less than that of both the retainer and the terminal, and upon melting, reflowing and solidifying, forms a good bond with the terminal or any material plated on the terminal, e.g. silver in the disclosed embodiment.

The terminal, instead of the retainer, could be coated with the metal or metal alloy; or both the terminal and the retainer could be coated with a metal or metal alloy. It is further recognized that other modifications are possible within the scope of the appended claims.

What is claimed is:

1. An integrated wire termination system comprising:

a contact terminal having a cylindrical cavity extending thereinto;

a retainer disposed in said cavity and having an annular portion with a slit thereacross engaging the inner cavity wall and inherently biased radially outwardly thereagainst;

means for securing said retainer in said terminal cavity comprising a coating of a metal or metal alloy on at least one of said retainer annular portion and said terminal inner cavity wall which in reflowed solidified condition comprises an electrical and mechanical bond between said retainer and said terminal, the melting point of said metal or metal alloy being less than that of both said retainer and said terminal, such that during said reflow said retainer annular portion radially expands towards said inner cavity wall to close gaps created therebetween by said reflow and to provide a biased tight fit during formation of said bond; and wire means including a terminating head pin inserted into said cavity and locked therein by said retainer.

2. The invention according to claim 1 wherein said retainer has said coating of said metal or metal alloy.

3. The invention according to claim 2 wherein said retainer is coated with tin.

4. The invention according to claim 3 wherein said terminal is plated with silver, said bond being formed between said tin on said retainer and said silver on said terminal.

5. The invention according to claim 4 wherein said terminal is made of brass and is nickel coated, and said silver plating covers said nickel coated terminal.

6. The invention according to claim 1 wherein said annular portion of said retainer has said slit thereacross extending along a longitudinal axis of said terminal, fillets of said reflowed solidified metal or metal alloy being present along opposing edges of said annular portion forming said slit whereby to afford visual access to said fillets on a line of sight into said terminal cavity along said longitudinal axis, said fillets intersecting said line of sight.

7. An integrated wire termination system comprising:

a cylindrical elongated terminal having a contact at one end and being hollow at the other end with a cylindrical cavity extending thereinto;

a retainer having an annular portion with a slit thereacross disposed in said terminal at said hollow end and inherently biased radially outwardly into engagement with the inner cavity wall thereof, said retainer further having a plurality of circumferentially spaced tabs extending from said annular portion further into said cavity and tapered inwardly toward the central longitudinal axis of said terminal;

means for securing said retainer in said terminal comprising a coating of a metal or metal alloy on at least one of said annular portion of said retainer and said inner cavity wall of said terminal which in reflowed solidified condition comprises an electrical and mechanical bond between said annular portion and said cavity wall, the melting point of said metal or metal alloy being less than that of both said retainer and said terminal, such that during said reflow said retainer annular portion radially expands towards said inner cavity wall to close gaps created therebetween by said reflow and to provide a biased tight fit during formation of said bond; and wire means including a cylindrical terminating head pin having an annularly larger shoulder portion which upon insertion of said pin laterally flexes at least one of said tabs outwardly away from said central longitudinal axis of said terminal until said at least one tab springs back inwardly to engage the backside of said shoulder portion to releasably lock said pin in said cavity;

an electrically conductive path being established from said wire means to said retainer to said metal or metal alloy bond to said terminal.

8. The invention according to claim 7 wherein said retainer has said coating of said metal or metal alloy.

9. The invention according to claim 8 wherein said retainer is coated with tin.

10. The invention according to claim 9 wherein said terminal is plated with silver, said bond being formed between said tin on said retainer and said silver on said terminal.

11. The invention according to claim 10 wherein said terminal is made of brass and is nickel coated, and said contact is brazed thereon, and said silver plating covers the contact and terminal assembly.

12. The invention according to claim 8 wherein said retainer is made of a high tensile strength, high copper alloy.

13. The invention according to claim 12 wherein said retainer is made of beryllium copper.

14. The invention according to claim 7 wherein at least another of said tabs extends further into said cavity than said one tab and engages an outer arcuate section of said shoulder portion of said pin when said one tab engages said backside of said shoulder portion.

15. The invention according to claim 7 wherein said said plurality of circumferentially spaced inwardly tapered tabs extending from said annular portion comprise two pairs of oppositely disposed tabs, the second pair extending further into said cavity than the first pair, said first pair of tabs being laterally flexed outwardly away from said central longitudinal axis of said terminal by said shoulder portion of said pin upon insertion of said pin until said first pair of tabs springs back to engage the backside of said shoulder portion, said second pair of tabs engaging arcuate sections of the outer circumference of said shoulder portion of said pin.

16. A method of making an integrated wire termination system for receiving and locking in place the terminating head pin of wire conductor means, said method comprising the steps of:

(a) providing a contact terminal having a cavity therein;

(b) providing a retainer with a slit and capable of receiving and locking in place said head pin;

(c) coating at least one of said terminal and said retainer with a metal or metal alloy having a melting point less than that of both said retainer and said terminal;

(d) inserting said retainer into said cavity in said terminal by radially compressing said retainer and narrowing said slit;

(e) heating said terminal and retainer to melt and reflow said metal or metal alloy coating to the other of said terminal and said retainer, radial expansion of said retainer closing gaps created by said reflow;

(f) cooling said terminal and retainer to solidify said reflowed metal or metal alloy coating to form an electrical and mechanical bond between said retainer and said terminal, said radial expansion of said retainer providing a biased tight fit during formation of said bond.

17. The method according to claim 16 wherein said coating step comprises coating said retainer.

18. The method according to claim 17 wherein said coating step comprises coating said retainer with tin.

19. The method according to claim 18 wherein said heating step comprises heating said terminal and retainer in a medium which substantially prevents formation of oxides on the surface of said tin and said terminal.

20. The method according to claim 19 wherein said heating step comprises immersing said terminal and retainer in hot oil to substantially prevent formation of oxides on the surfaces of said tin and said terminal and to reduce surface tension of said tin to facilitate flowing thereof.

21. The method according to claim 20 wherein said temperature of said oil is about 480°±10° F.

22. The method according to claim 19 wherein the step of providing a retainer comprises providing a retainer of high tensile strength beryllium copper.

23. The method according to claim 19 wherein the step of providing a contact terminal comprises coating said terminal with silver whereby said bond is formed between the tin on said retainer and the silver on said terminal.

24. The method according to claim 23 wherein the step of providing a contact terminal comprises:

providing a terminal made of brass;

coating said brass terminal with nickel;

brazing a contact on said terminal; and plating said contact and terminal with silver.

25. The method according to claim 16 further comprising a visual inspection step comprising establishing a line of sight into said cavity along said slit, the intersection of said line of sight by fillets of said reflowed solidified metal or metal alloy at the interface of said retainer and the cavity wall of said terminal along opposing edges of said retainer forming said slit indicating an acceptable bond.

* * * * *